United States Patent [19]

Shah

[11] Patent Number: 4,991,390

[45] Date of Patent: Feb. 12, 1991

[54] MOUNTING AND COOLING TURBINE NOZZLE VANES

[75] Inventor: Nipulkumar Shah, San Diego, Calif.

[73] Assignee: Sundstrand Corporation, Rockford, Ill.

[21] Appl. No.: 248,602

[22] Filed: Sep. 26, 1988

[51] Int. Cl.[5] ..... F02C 7/12

[52] U.S. Cl. ..... 60/39.36; 60/39.75; 60/760; 415/115

[58] Field of Search ..... 60/39.36, 760, 39.75, 60/39.43, 39.83; 415/115; 416/96 A, 97 R; 417/406

[56] References Cited

U.S. PATENT DOCUMENTS

| | | | |
|---|---|---|---|
| 2,709,893 | 6/1955 | Birmann | 60/39.36 |
| 3,199,294 | 8/1965 | Hagen | 60/39.75 |
| 3,623,318 | 11/1971 | Shank | 60/39.75 |
| 3,994,630 | 11/1976 | Rodgers | 60/39.43 |
| 4,469,470 | 9/1984 | Geary | 60/39.75 |
| 4,800,717 | 1/1989 | Rodgers | 60/39.36 |

*Primary Examiner*—Donald E. Stout

*Attorney, Agent, or Firm*—Wood, Phillips, Mason, Recktenwald & Vansanten

[57] ABSTRACT

The cooling and mounting of vanes 50 in a turbine nozzle 24 between shrouds 28, 29 is facilitated by impaling the vanes 50 with threaded fasteners 54, 70 and conducting relatively cool air from the compressor 15 through the grooves 72 between adjacent threads 70 of the threaded fastener 54.

12 Claims, 2 Drawing Sheets

FIG. 3
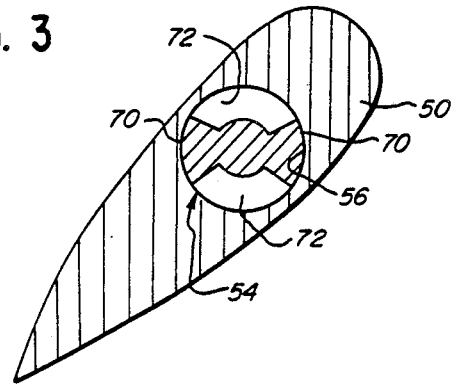
FIG. 4
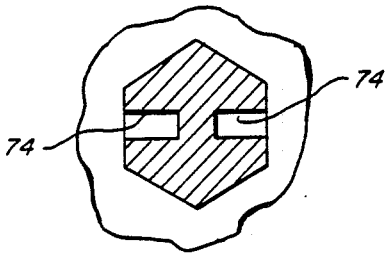
FIG. 5
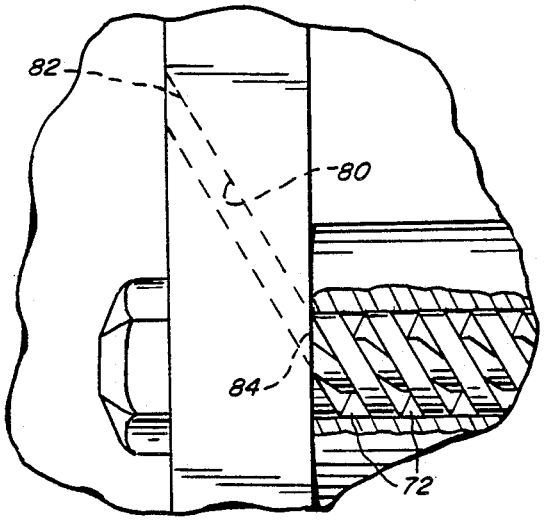
FIG. 7
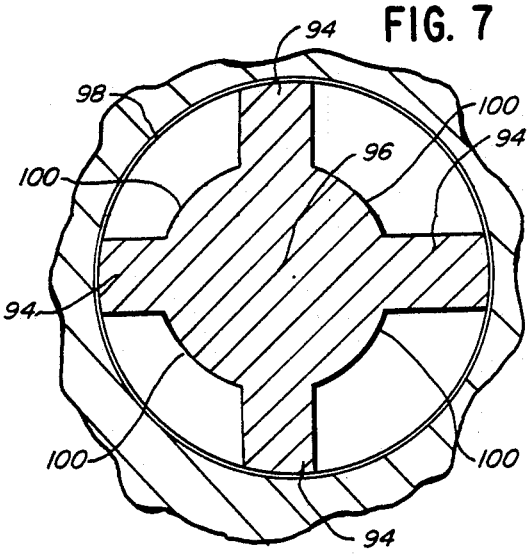
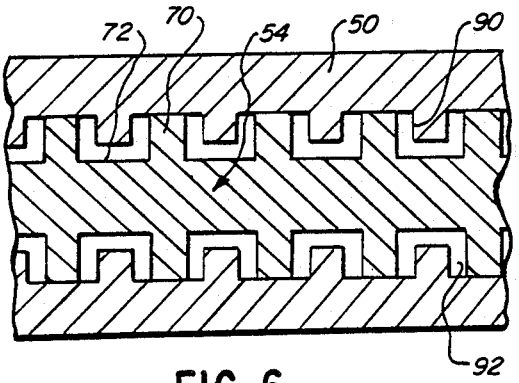
FIG. 6

MOUNTING AND COOLING TURBINE NOZZLE VANES

FIELD OF THE INVENTION

This invention relates to gas turbine engines, and more particularly, to the mounting and cooling of turbine nozzle vanes in such engines.

BACKGROUND OF THE INVENTION

As one seeks to increase the power output of a turbine engine of a given size, generally the process leads to increasing temperatures of the gases of combustion exiting combustor to the turbine nozzle which directs the gases against a turbine wheel to drive the same. Conventionally, the nozzles are formed of a plurality of vanes and such vanes, being in the gas stream, must survive the higher temperatures. It is also required that the vanes survive the thermal and mechanical loading that is placed on them during engine cycles. And, of course, some means must be employed to mount them in the proper location to perform their intended function.

Various means of cooling the nozzle vanes in turbine engines have been proposed. While many such ideas have been quite effective, the problem of vane cooling becomes particularly different in small gas turbine engines. For example, in one known type of engine made by the assignee of the instant application, the vanes are assembled with a combustor or rear shroud by rivet-like pins which have a thickness of but 0.2 inches. This readily demonstrates the small size of the components involved and indicates that the technique of using complex internal air passages within the vanes is not practical and/or extremely expensive.

The present invention is directed to overcoming one or more of the above problems.

SUMMARY OF THE INVENTION

It is the principal object of the invention to provide a new and improved turbine engine. More specifically, it is an object of the invention to provide a unique means for both mounting and cooling the vanes utilized in the turbine nozzle of turbine engines.

An exemplary embodiment of the invention achieves the foregoing object in a turbine engine including a rotary compressor and a radial inflow turbine wheel coupled to the compressor to drive the same. Axially spaced front and rear shrouds are provided for the turbine wheel and an annular combustor is disposed about the turbine wheel for receiving compressed air from the compressor and fuel from a source and combusting the same to produce gases of combustion. A turbine nozzle is disposed about the turbine wheel and is for receiving gases of combustion from the combustor and directing the same at the turbine wheel to drive the turbine wheel. The nozzle comprises angularly spaced vanes extending generally axially between the shrouds and located radially outwardly of the turbine wheel. Means are provided for mounting the vanes between the shrouds and comprise generally axial bores in the vanes and aligned openings in the shrouds along with elongated elements extending through and between the shrouds and impaling corresponding vanes by extending through the associated bores therein. Fasteners are provided for the elements to hold the same in place and cooling means for the vanes are provided in the form of a gap between the bores and the associated elongated elements, which gap is in fluid communication with the compressor.

In a highly preferred embodiment, the elongated elements are threaded fasteners and the gap is defined by the space between threads.

In a highly preferred embodiment, the pitch of the threaded fasteners is greater than one.

The invention contemplates that the elongated elements have helical grooves of variable depth about its periphery in one embodiment of the invention. In this embodiment, the depths of the groove may vary angularly about the peripheries of the respective elongated elements.

In a highly preferred embodiment, the elongated elements define a generally cylindrical envelope.

The invention contemplates that the gaps be defined by grooves in the bores or by grooves in the elongated elements.

In a highly preferred embodiment, constructions such as those mentioned immediately preceding include cooling air inlet ports in either the front shroud or the threaded fasteners which open to the side of the front shroud remote from the vanes and which are in fluid communication with the compressor and with spaces between adjacent convolutions of the threads of the threaded fasteners.

Other objects and advantages will become apparent from the following specification taken in connection with the accompanying drawings.

DESCRIPTION OF THE DRAWINGS

FIG. 3 is a sectional view taken approximately along the line 3—3 in FIG. 2;

FIG. 4 is a sectional view taken approximately along the line 4—4 in FIG. 2;

FIG. 5 is a fragmentary view somewhat similar to FIG. 2 but showing a modified embodiment of the invention;

FIG. 6 is a fragmentary, sectional view showing a further modified embodiment of the invention; and FIG. 7 is an enlarged, fragmentary view illustrating still a further modified embodiment of the invention.

DESCRIPTION OF THE PREFERRED EMBODIMENTS

Figure 1:
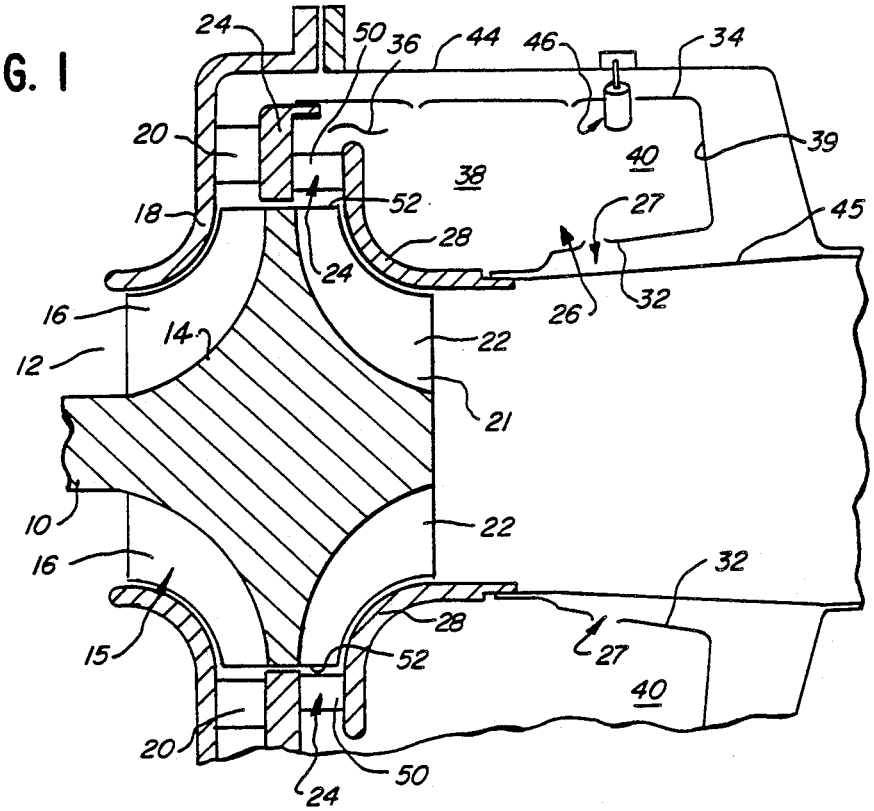
FIG. 1 is a somewhat schematic, sectional view of a turbine engine made according to the invention.

An exemplary embodiment of a gas turbine made according to the invention is illustrated in the drawings and includes a rotary shaft 10 journaled by bearings not shown. Adjacent one end of the shaft 10 is an inlet area 12. The shaft 10 mounts a rotor, generally designated 14, which may be of conventional construction. Accordingly, the same includes a compressor section, generally designated 15, including a plurality of compressor blades 16 adjacent the inlet 12. A compressor shroud 18 is provided in adjacency thereto and just radially outwardly of the radially outer extremities of the compressor blades 16 is a conventional diffuser.

Oppositely of the compressor blades, the rotor 14 includes a turbine wheel, generally designated 21, including a plurality of turbine blades 22. Just radially outwardly of the turbine blades 22 is an annular nozzle, generally designated 24, which is adapted to receive hot gases of combustion, along with dilution air, from an annular combustor, generally designated 26. The compressor 15 including the blades 16, the shroud 18 and the diffuser 20 delivers compressed air to the annular combustor 26 and via dilution air passages 27, to the nozzle 24 along with the gases of combustion. That is to say, hot gases of combustion from the combustor 26 are directed via the nozzle 24 against the blades 22 to cause rotation of the rotor 14 and thus the shaft 10. The latter may be, of course, coupled to some sort of apparatus requiring the performance of useful work or, in the alternative, the hot gases discharged through an exhaust nozzle (not shown) to generate thrust.

A turbine blade or rear shroud 28 is interfitted with the combustor 26 to close off the flow path from the nozzle 24 and confine the expanding gas to the area of the turbine blades 22. A front or diffuser shroud 29 is axially spaced from the shroud 28 and isolates compressed air from the compressor section 15 and hot gases of combustion.

The combustor 26 has a generally cylindrical inner wall 32 and a generally cylindrical outer wall 34. The two are concentric with each other and with the rotational axis of the shaft 10 and merge to a necked down area 36 which serves as an outlet from an interior annulus 38 defined by the space between the walls 32 and 34 of the combustor 26. Such outlet 36 extends to the nozzle 24. The third wall 39, generally concentric with the walls 32 and 34 extends generally radially to interconnect the walls 32 and 34 and to further define the annulus 38.

Opposite of the outlet 36 and adjacent the wall 39, the interior annulus 38 of the combustor includes a primary combustion zone 40 in which the burning of fuel primarily occurs. The primary combustion zone 40 is an annulus or annular space defined by the generally radially inner wall 32, the generally radially outer wall 34 and the radial wall 39. As mentioned earlier, provision is made for the injection of dilution air through the passages 27 into the combustor 26 to cool the gases of combustion to a temperature more suitable for application to the turbine blades 22 via the nozzle 24 as well as the nozzle 24 itself.

A further annular wall 44 is generally concentric to the walls 32 and 34 and is located radially outward of the latter. Similarly, an inner annular wall 45 inside the wall 32 is provided and together with the wall 44 provides a plenum surrounding the combustor 26. The wall 44 extends to the front shroud 29 and thus serves to contain and direct compressed air from the compressor system to the combustor 26.

Mounted on the wall 44 and extending through the wall 34 are main fuel injectors, generally designated 46. The injectors 46 inject fuel from a source into the combustor 26 to be combined with air from the compressor 15. The resulting mixture is combusted and exits the combustor 26 via the outlet 36 to the nozzle 24.

As is well known, the nozzle 24 is made up of a plurality of vanes 50 which extend axially between the front shroud 29 and the rear shroud 28. They are located, as can be seen from FIG. 1 and FIG. 2, just radially outwardly of the tips 52 of the blades 22.

Figure 2:
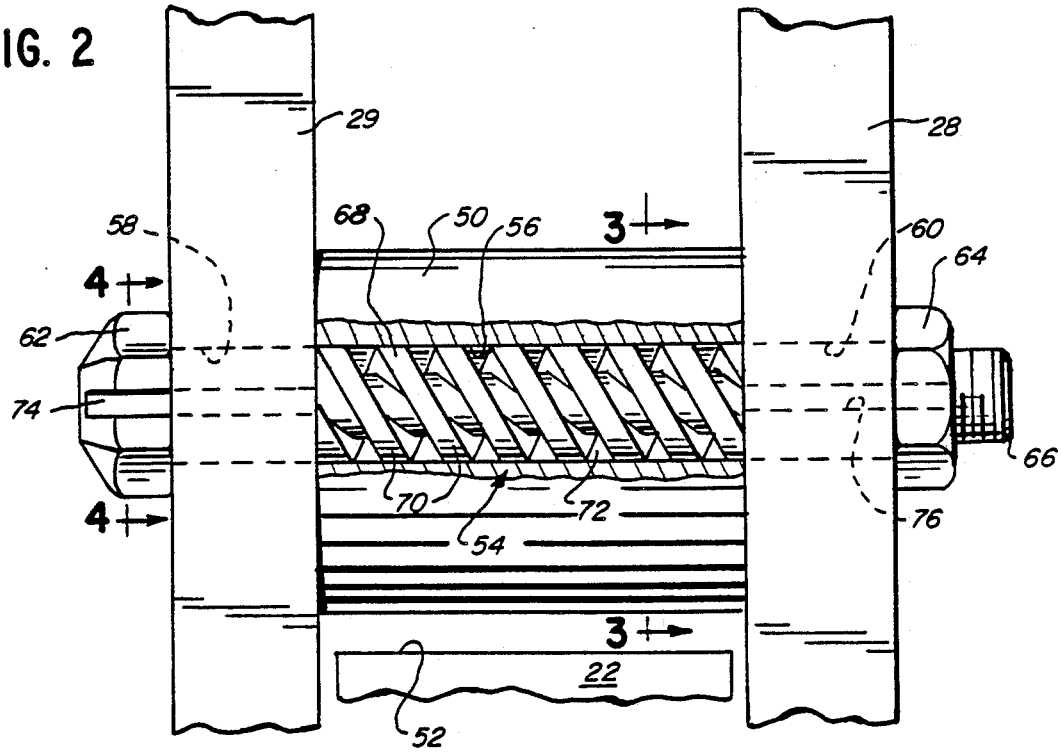
FIG. 2 is an exploded, fragmentary sectional view of part of a turbine nozzle.

As a alluded to previously, the front shroud 29, the rear shroud 28 and the vanes 50 are mounted together with the latter in angularly spaced relation by elongated elements extending between the shrouds 28 and 29. As seen in FIG. 2, one such elongated element having a cylindrical envelope and generally designated 54, extends through a cylindrical bore 56 that is generally axially oriented as well as through aligned openings 58 and 60 in the front and rear shrouds 29, 28, respectively. In a preferred form of the invention, each elongated element 54 is a threaded fastener having an enlarged head 62 at one end which may abut the side of the shroud 29 remote from the associated vane 50. At its opposite end, a fastener in the form of a nut 64 is received on a threaded section 66 of reduced diameter and abuts the side of the shroud 28 remote from the vane 50.

Intermediate the head 62 and the section 66, the shank 68 of the elongated element 54 may be provided with threads 70 which in turn define helical grooves 72. In the embodiment illustrated in FIG. 2, a double threaded elongated element 54 is used. That is to say, in this embodiment, pitch of the threads 70 is greater than one, namely, two.

As seen in FIGS. 2 and 4, the head 62 is provided with diametrically opposite axially extending grooves 74 which are of sufficient depth and length so as to extend from the head 62 to be in fluid communication with a corresponding one of the grooves 72 defined by the thread 70. The head 62 being on the compressor side of the front shroud 29 will thus be in fluid communication with the compressor 15 and as a consequence, the axial grooves 70 define inlet ports whereby the relatively cool air from the compressor may enter the bore 56 and flow therealong in a helical path defined by the threads 70. A similar groove 76 may be formed on the threaded fastener 54 and/or nut 64 to extend to the side of the rear shroud 28 remote from the vane 54 to define outlet ports.

As a result of this construction, a plurality of cooling air streams equal in number to the pitch of the threads 70 trace a helical path within the bore 56 of each vane 50 to cool the same. At the same time, the elongated elements 54 serve the usual mounting function.

Preferably, so-called square threads as illustrated in FIG. 2 are utilized so that good contact between their helical periphery and the interior of the bore 56 may be had to enhance heat transfer by conduction from the vane 50 to the threads 70 and ultimately to the air passing between the threads 70.

In some instances, the groove 74 may be dispensed with in favor of internal ports 80 drilled or otherwise formed in the front shroud 29 as illustrated in FIG. 5. The ports 80 terminate at one end 82 at or near the diffuser 20 to receive compressed air and at their opposite ends 84 in alignment with grooves 72 in the elongated element 54.

FIG. 6 illustrates still another embodiment of the invention. In this embodiment, the cylindrical bore 56 is dispensed with in favor of one that is internally threaded with threads 90. The threads 90 interfit with the threads 70 but are spaced therefrom to provide passages 92 that appear U-shaped in section as can be seen from FIG. 6. In this embodiment of the invention, heat transfer is enhanced because of the resulting increase in surface area fronting on the passages 92.

FIG. 7 illustrates still another modification of the invention. It is a view somewhat similar to FIG. 3 but illustrates an elongated element utilizing four threads 94. This threaded fastener is conventionally formed and then is machined so that its original center shown at 96 is eccentrically located with respect to its periphery 98. This in turn means that the depth of the grooves 100 between the threads 94 varies angularly about the threaded fastener. That is to say, as seen in FIG. 7, as one proceeds in a clock-wise direction from about the 12 o'clock position, increasing depth of the grooves 100 occurs for the first 90° followed by decreasing depth for the next 180° and then increasing depth once again for the last 90°; and this occurs repetitively along the entire length of the threaded fastener.

When this type of fastener is employed, it will be appreciated that the flow of cooling air is accelerated as the depth of the groove 100 decreases and this turn will mean an increased Reynolds Numbers. That in turn means enhanced heat transfer. Consequently, a threaded fastener such as illustrated in FIG. 7 may be angularly disposed within the bore 56 of a vane 50 so that the 9 o'clock position is located in angular alignment with that part of the vane 50 requiring the greatest degree of heat transfer.

From the foregoing, it will be appreciated that the invention provides a means whereby assembly of the shrouds 28, 29 and vanes 50 to form a turbine nozzle 24 is accomplished with the additional benefit of vane cooling being achieved as well. The invention is relatively simple to implement and does not include complicated shapes for forming passages within the vanes 50 themselves and therefore may be employed with good efficiency and economy.

I claim:

1. A turbine engine comprising:

a rotary compressor;

a radial inflow turbine wheel coupled to said compressor to drive the same;

axially spaced front and rear shrouds for said turbine wheel;

an annular combustor disposed about said turbine wheel for receiving compressed air from the compressor and fuel from a source and combusting the same to produce gases of combustion;

a turbine nozzle disposed about said turbine wheel for receiving gases of combustion from said combustor and directing the same at said turbine wheel to drive said turbine wheel, said nozzle comprising angularly spaced vanes extending generally axially between said shrouds radially outwardly of said turbine wheel;

means mounting said vanes between said shrouds comprising a generally axial bore in each said vane and aligned openings in said shrouds and elongated elements extending through and between said shrouds and impaling corresponding vanes by extending through the associated bore, and fasteners for said elements to hold the same in place; and cooling means for said vanes comprising a gap between said bores and the associated elongated elements and in fluid communication with said compressor;

said elongated elements being threaded fasteners; and said gap being defined by the space between threads.

2. The turbine engine of claim 1 wherein the pitch of said threaded fasteners is greater than one.

3. A turbine engine comprising:

a rotary compressor;

a radial inflow turbine wheel coupled to said compressor to drive the same;

axially spaced front and rear shrouds for said turbine wheel;

an annular combustor disposed about said turbine wheel for receiving compressed air from the compressor and fuel from a source and combusting the same to produce gases of combustion;

a turbine nozzle disposed about said turbine wheel for receiving gases of combustion from said combustor and directing the same at said turbine wheel to drive said turbine wheel, said nozzle comprising angularly spaced vanes extending generally axially between said shrouds radially outwardly of said turbine wheel;

means mounting said vanes between said shrouds comprising a generally axial bore in each said vane and aligned openings in said shrouds and elongated elements extending through and between said shrouds and impaling corresponding vanes by extending through the associated bore, and fasteners for said elements to hold the same in place; and cooling means for said vanes comprising a gap between said bores and the associated elongated elements and in fluid communication with said compressor;

each elongated element having a helical, variable depth groove about its periphery.

4. The turbine engine of claim 3 wherein the depths of said grooves varies angularly about peripheries of the respective elongated elements.

5. A turbine engine comprising:

a rotary compressor;

a radial inflow turbine wheel coupled to said compressor to drive the same;

axially spaced front and rear shrouds for said turbine wheel;

an annular combustor disposed about said turbine wheel for receiving compressed air from the compressor and fuel from a source and combusting the same to produce gases of combustion;

a turbine nozzle disposed about said turbine wheel for receiving gases of combustion from said combustor and directing the same at said turbine wheel to drive said turbine wheel, said nozzle comprising angularly spaced vanes extending generally axially between said shrouds radially outwardly of said turbine wheel;

means mounting said vanes between said shrouds comprising a generally axial bore in each said vane and aligned openings in said shrouds and elongated elements extending through and between said shrouds and impaling corresponding vanes by extending through the associated bore, and fasteners for said elements to hold the same in place; and cooling means for said vanes comprising a gap between said bores and the associated elongated elements and in fluid communication with said compressor;

said gaps being defined by grooves in said bores.

6. The turbine engine of claim 5 wherein said gaps are further defined by grooves in said elongated elements.

7. A turbine engine comprising:

a rotary compressor;

a radial inflow turbine wheel coupled to said compressor to drive the same;

axially spaced front and rear shrouds for said turbine wheel;

an annular combustor disposed about said turbine wheel for receiving compressed air from the compressor and fuel from a source and combusting the same to produce gases of combustion;

a turbine nozzle disposed about said turbine wheel for receiving gases of combustion from said combustor and directing the same at said turbine wheel to drive said turbine wheel, said nozzle comprising angularly spaced vanes extending generally axially between said shrouds radially outwardly of said turbine wheel;

means mounting said vanes between said shrouds comprising a generally axial bore in each said vane and aligned openings in said shrouds and threaded fasteners extending through and between said shrouds and impaling corresponding vanes by extending through the associated bores;

cooling air inlet ports in one of said front shroud and said threaded fasteners and opening to the side of said front shroud remote from said vanes and in fluid communication with said compressor and with the spaces between adjacent convolutions of the threads on said threaded fasteners.

8. The turbine engine of claim 7 wherein said ports are in said threaded fastener.

9. The turbine engine of claim 7 wherein said ports are in said front shroud.

10. A turbine engine comprising:

a rotary compressor;

a radial inflow turbine wheel coupled to said compressor to drive the same;

axially spaced front and rear shrouds for said turbine wheel;

an annular combustor disposed about said turbine wheel for receiving compressed air from the compressor and fuel from a source and combusting the same to produce gases of combustion;

a turbine nozzle disposed about said turbine wheel for receiving gases of combustion from said combustor and directing the same at said turbine wheel to drive said turbine wheel, said nozzle comprising angularly spaced vanes extending generally axially between said shrouds radially outwardly of said turbine wheel;

means mounting said vanes between said shrouds comprising a generally axial bore in each said vane and aligned openings in said shrouds and elongated elements extending through and between said shrouds and impaling corresponding vanes by extending through the associated bores;

cooling means for said vanes comprising a gap between each said bore and the associated elongated element; and cooling air inlet ports in one of said front shroud and said elongated elements and opening to the side of said front shroud remote from said vanes and in fluid communication with said compressor and with said gaps.

11. The turbine engine of claim 10 wherein said ports are in said elongated elements.

12. The turbine engine of claim 10 wherein said ports are in said front shroud.

* * * * *